US008833318B2

(12) United States Patent
Strauss et al.

(10) Patent No.: US 8,833,318 B2
(45) Date of Patent: Sep. 16, 2014

(54) DEVICE FOR THE VARIABLE ADJUSTING OF THE CONTROL TIMING OF GAS EXCHANGE VALVES OF AN INTERNAL COMBUSTION ENGINE

(75) Inventors: Andreas Strauss, Forchheim (DE); Kurt Kirsten, Graz (AT)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 285 days.

(21) Appl. No.: 13/375,576

(22) PCT Filed: Jun. 15, 2010

(86) PCT No.: PCT/EP2010/058389

§ 371 (c)(1),
(2), (4) Date: Dec. 1, 2011

(87) PCT Pub. No.: WO2011/012370

PCT Pub. Date: Feb. 3, 2011

(65) Prior Publication Data

US 2012/0079998 A1 Apr. 5, 2012

(30) Foreign Application Priority Data

Jul. 25, 2009 (DE) ..... 10 2009 034 512

(51) Int. Cl.
*F01L 1/34* (2006.01)
*F01L 1/344* (2006.01)

(52) U.S. Cl.
CPC ..... *F01L 1/3442* (2013.01); *F01L 2001/34446* (2013.01); *F01L 2001/34469* (2013.01)
USPC ..... 123/90.17; 123/90.12

(58) Field of Classification Search
CPC ..... F01L 2001/34446
USPC ..... 123/90.12, 90.13, 90.15, 90.17
See application file for complete search history.

(56) References Cited

U.S. PATENT DOCUMENTS 7,866,764 B2 * 1/2011 Crimpita ..... 303/119.3

FOREIGN PATENT DOCUMENTS

| | | | |
|---|---|---|---|
| DE | 4218078 | | 1/1994 |
| DE | 102007041552 | | 3/2009 |
| DE | 102007056683 | * | 5/2009 |
| WO | WO 2008140897 A1 | * | 11/2008 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A device (11) for the variable adjusting of the control timing of gas exchange valves (9, 10) of an internal combustion engine (1) with a drive element (13), an output element (14), at least one pressure chamber (23) and a volume accumulator (31), wherein the output element (14) is arranged in a rotatable manner to the drive element (13), and the pressure chamber (23) is bordered at least partially by these components (13, 14), wherein a phase position between the output element (14) and the drive element (13) can be variably adjusted by the pressure medium supply to or pressure medium removal from the pressure chamber (23). Pressure medium lines (25*a, b, p*) are provided by which the pressure medium can be supplied to the pressure chamber (23) or removed therefrom. The volume accumulator (31) has at least one housing (32) and a displaceable separating element (33) therein that separates a supply chamber (34), which connects to one of the pressure medium lines (25*a, b, p*), from a ventilated complementary space (35). The separating element (33) is displaced in the housing (32) by the admission of the pressure medium in the supply chamber (34) in such a way that the volume of the supply chamber (34) increases at the expense of the complementary space (35).

12 Claims, 4 Drawing Sheets

DEVICE FOR THE VARIABLE ADJUSTING OF THE CONTROL TIMING OF GAS EXCHANGE VALVES OF AN INTERNAL COMBUSTION ENGINE

BACKGROUND

The invention relates to a device for the variable adjustment of control timing of gas exchange valves of an internal combustion engine with a drive element, an output element, at least one pressure chamber, and a volume accumulator, with the output element being arranged rotatably in reference to the drive element, and the pressure chamber being partially limited by said parts, with a phase position between the drive element and the output element being adjustable in a variable fashion by supplying and/or removing pressure medium from the pressure chamber, with pressure medium lines being provided via which pressure medium can be supplied to the pressure chamber or from which it can be removed, with the volume accumulator comprising at least one housing and a separating element that can be displaced therein, which separates a supply chamber communicating with the pressure medium lines from a ventilated complementary chamber, with by the impingement of pressure medium from the supply chamber, the separating element is displaced in the housing such that the volume of the supply chamber increases at the expense of the complementary chamber.

In modern internal combustion engines devices are used for variably adjusting the control timing of gas exchange valves, in order to allow variable designing of the phase position of a camshaft in reference to a crankshaft within a defined angular range between a maximum early and a maximum late position. For this purpose, the device is integrated in a drive train by which torque is transferred from the crankshaft to the camshaft. This drive train can be realized as a belt, chain, or gear drive, for example.

Such a device is known for example from DE 10 2007 041 552 A1. The device comprises a phase position device with a drive element which is in a drive connection with the crankshaft, and which is connected to an output element connected to the camshaft in a torque-proof fashion. Furthermore, the phase position device comprises several pressure chambers with each of the pressure chambers being divided by an impeller into two mutually influencing pressure chambers. By the supply of pressure medium to and/or draining of pressure medium from the pressure chambers, the blades inside the pressure chambers are displaced, leading to a change of the phase position between the output element and the drive element.

The supply of pressure medium to and/or the pressure medium drained from the pressure chambers is controlled via a hydraulic circuit comprising a pressure medium pump, a pressure medium reservoir, a control valve, and several pressure medium lines. The control valve comprises several pressure medium connectors, with one pressure medium line connecting the pressure medium pump to the control valve. One additional pressure medium line each connects one of the operating connections of the control valve to one group each of the oppositely operating pressure chambers.

During operation of the internal combustion engine alternating torques impinge the camshaft, each of which is caused by the cams rolling over gas exchange valves pre-stressed by a valve spring. These torques are transferred to the phase adjustment device and act by braking and/or accelerating the adjustment speed of the phase position. Here, when opening the gas exchange valve a phase adjustment occurs in the direction of a later control timing and when closing the gas exchange valve a phase adjustment is supported in the direction of an earlier control timing. During the phases in which the alternating torques support the phase adjustment the need for pressure medium of the phase adjustment device increases rapidly and can exceed the volume flow rate transported by the pressure medium pump. In this case, the phase adjustment speed is not determined by the supporting alternating torque but by the volume flow rate of the pressure medium pump. In this case, the supporting contribution of the alternating torques cannot be fully utilized. The smaller the dimensioning of the pressure medium pump the more distinct is this negative effect.

In each operating phase of the internal combustion engine the volume flow rate required by the phase adjustment device in order to ensure the function of the phase position adjustment the pressure medium pump must supply. For this purpose a volume accumulator is provided in DE 10 2007 041 552 A1, which communicates with the pressure medium line connecting the pressure medium pump with the control valve. In phases in which the pressure medium required by the phase adjustment device is lower than the volume of pressure medium transported by the pressure medium pump, the volume accumulator is filled. Here, a piston inside a housing is displaced against a force accumulator, in the exemplary embodiment shown a pressure spring. In these phases the force accumulator is stressed, i.e. the force accumulator accepts an amount of energy which can be resupplied to the hydraulic system. When the system pressure falls, the volume accumulator empties under the influence of the relaxing force accumulator into the hydraulic circuit and thus supports the phase adjustment of the camshaft in reference to the crankshaft.

In the exemplary embodiment shown it is disadvantageous that due to the stressed pressure spring, the emptying of the volume accumulator begins to occur already at a point of time at which the volume flow rate supplied by the pressure medium pump is sufficient to ensure the adjustment. The volume of pressure medium displaced in this phase from the volume accumulator is no longer available in the phases of insufficient supply of the phase adjustment device.

SUMMARY

The invention is based on the objective of providing a device for variably adjusting the control timing of gas exchange valves of an internal combustion engine with the braking effect acting upon the phase adjustment device, caused by insufficient supply of pressure medium, is minimized without requiring enlarging the size of the pressure medium pump of the internal combustion engine.

The objective is attained according to the invention such that the volume accumulator comprises a force accumulator which is stressed when the supply chamber is filled.

The phase adjustment device is embodied for example in the form of an adjustment impeller and comprises a drive element which for example is driven via a traction mechanism or gear drive by a crankshaft of the internal combustion engine. Furthermore, an output element is provided, which has a constant phase position in reference to the camshaft, for example via a friction, force, or material-fitting connection, or a screwed connection thereto in a torque-proof fashion. The output element is arranged rotational in reference to the drive element and at least partially accepted therein. Within the phase adjustment device at least one pressure chamber is provided. By supplying pressure medium to and/or draining pressure medium from the pressure chamber, a relative phase position of the output element in reference to the drive element and thus the camshaft in reference to the crankshaft can be variably adjusted For this purpose, pressure medium lines are provided, by which the pressure chamber, for example with a hydraulic control valve being interposed, can communicate with a pressure medium pump and a pressure medium reservoir of the internal combustion engine.

Alternatively, other embodiments of the phase adjustment device may also be provided, for example a phase adjustment device in an axially adjusting design, in which a piston, which can be axially displaced by pressure medium, cooperates via diagonal gears with the output element and the drive element. Such a phase adjustment device is known, for example, from DE 42 18 078 C1.

Additionally, a volume accumulator is provided comprising at least a housing and a separating element arranged inside said housing. The separating element may be embodied as a piston or a non-elastic diaphragm, and separates a supply chamber from a complementary chamber in the interior of the housing. Here, the supply chamber communicates with a pressure medium line, while the complementary chamber is ventilated, and for example communicates with the interior of the internal combustion engine. If the pressure medium line connected to the volume accumulator guides pressure medium the supply chamber fills and the separating element is displaced within the housing such that the volume of the supply chamber is enlarged and the volume of the complementary chamber accordingly reduced. Here, it may be provided that the complementary chamber comprises a ventilation opening, which communicates with the interior of the internal combustion engine. This way, gas can evaporate from the complementary chamber, for example into the crank housing or the cylinder head of the internal combustion engine so that no pressure develops in the complementary chamber.

When a piston is used as the separating element it is displaced during the filling of the supply chamber inside the housing. In case of a diaphragm it everts in the direction of the complementary chamber.

Due to the fact that no force accumulator is provided which is stressed during the filling process of the volume accumulator the filling occurs already at minimal operating pressures. Furthermore, the filled volume accumulator initially fails to empty under falling pressure into the pressure medium line. The supply chamber empties into the pressure medium line only when the pressure in the pressure medium line falls below the pressure existing in the complementary chamber, and thus for example within the crank housing. Thus, the entire volume of the volume accumulator of the phase adjustment device is only available from the moment of time at which the need for pressure medium is greater than the volume flow rate provided by the pressure medium pump. This way, alternating torques acting upon the camshaft can be used to a higher degree, which leads to considerably higher adjustment speeds.

When the internal combustion engine is turned off no forces impinge the separating element so that it is freely displaceable. During the operation of the internal combustion engine only one force impinges the surface of the separating element limiting the supply chamber, which is determined by the pressure existing in the pressure medium line communicating with the supply chamber. The area of the separating element limiting the complementary chamber is held essentially unaffected due to the ventilation. In particular, no force is applied to this area which increases with the fill level of the supply chamber, which is the case in pressure spring—volume accumulators. When the pressure in the pressure medium line communicating with the supply chamber exceeds the atmospheric pressure (=pressure in the chamber communicating with the complementary chamber) the volume accumulator is and/or remains filled. Only when the pressure in the pressure medium line falls below the atmospheric pressure the pressure medium is suctioned from the volume accumulator into the pressure medium line and is therefore available for the phase adjustment. Thus, the separating element is exclusively displaced by the pressure existing in the pressure medium line communicating with the volume accumulator.

In a more concrete design of the invention it is provided that the device furthermore comprises a control valve and at least one second pressure chamber, which acts against the first pressure chamber and that a first pressure medium line communicates with the control valve and the first pressure chamber such that a second pressure medium line communicates with the control valve and the second pressure chamber and that a third pressure medium line communicates with the control valve and the pressure medium pump, with the supply chamber communicating with the third pressure medium line.

In this embodiment a pressure chamber is provided inside the phase adjustment device, which is separated by a piston or a blade of an impeller into two oppositely acting pressure chambers. Each of the pressure chambers communicates via a pressure medium line with the operating connection of a control valve. Furthermore, another pressure medium line is provided, which connects the pressure medium pump with a supply connection of the control valve. The pressure medium pump can be optionally connected via the control valve to the first or the second pressure chamber. Simultaneously the other pressure chamber is connected to the pressure medium reservoir, so that the piston and/or the vane are displaced inside the pressure chamber. This motion is directly or indirectly transferred into an adjustment of the phase position of the output element in reference to the drive element. By the connection of the storage chamber to the pressure medium line connecting the pressure medium pump with the control valve the pressure medium is available both for adjustment processes in the direction of earlier as well as for adjustment processes in the direction of later control timing. Here, it is provided that the supply chamber is connected between the control valve and the pressure medium pump into the third pressure medium line.

Furthermore, it may be provided that one check valve is arranged upstream in the pressure medium line communicating with the supply chamber and one check valve downstream in reference to the volume accumulator, with both check valves preventing a reflux of pressure medium in the direction of the volume accumulator and/or the pressure medium pump. The check valves prevent that pressure medium from the pressure chambers to be filled, for example the pressure chambers connected to the supply connection of the control valve, can flow back into the volume accumulator or the pressure medium pump, when based on the alternating torques acting upon the camshaft pressure peaks develop in these pressure chambers. The pressure medium is therefore supported by the check valves, thus increasing the speed of the phase adjustment and preventing phase fluctuations.

The separating element can be embodied for example as a piston. Here, it may be embodied from plastic and additionally comprise reinforcement ribs. Alternatively the piston may also be embodied cup-shaped and made from a sheet-metal blank. Disk-shaped pistons are also possible. The piston can separate the supply chamber from the complementary chamber via play adjustment in the housing. Alternatively the piston may be provided with a sealing element, which cooperates with the housing in a sealing fashion.

In a further development of the invention it is provided that in the complementary chamber a limit stop is provided for the piston. The limit stop may be embodied in one piece with the housing or produced separately. Here it may be provided that the contact surface of the limit stop is embodied smaller than the area of the piston, which limits the complementary chamber. This way it is prevented that the piston engages the housing or the limit stop in a planar fashion, thus adhesion forces countering the emptying of the volume accumulator are reduced. The limit stop may be embodied surrounding a ventilation opening of the complementary chamber. Here, the limit stop may completely surround the ventilation opening or be embodied with one or more interruptions.

The volume accumulator may be arranged inside the internal combustion engine, for example. In this case, the gas and pressure medium may directly be ventilated from the complementary chamber into the interior of the internal combustion engine via a simple ventilation opening, additional seals are not necessary. Alternatively it may be provided that the volume accumulator is arranged outside the internal combustion engine, with a vent line being provided, which communicates on the one side with the complementary chamber and on the other side with the interior of the internal combustion engine. The vent line may be embodied in the housing of the volume accumulator or an additional housing, for example, encapsulating the volume accumulator. In this embodiment gaskets are provided, which seal the vent line and the connection between the supply chamber and the pressure medium line from the environment.

The volume accumulator may be connected, for example, via a thread embodied at the cylinder head, the crank housing, or another environmental construction. Advantageously the thread comprises an opening by which the supply chamber communicates with the pressure medium line.

In a more precise embodiment of the invention it is provided that the volume accumulator is arranged inside the camshaft. This way the volume accumulator can be integrated without increasing the space required for the internal combustion engine. Furthermore, this way a minimal distance is implemented between the volume accumulator and the phase adjustment device and thus the reaction behavior. Here, the interior wall of the camshaft serves as the housing in which the separating element is received.

BRIEF DESCRIPTION OF THE DRAWINGS

Additional features of the invention are discernible from the following description and the drawings, in which exemplary embodiments of the invention are shown in a simplified illustration. Shown are.

DETAILED DESCRIPTION OF THE PREFERRED EMBODIMENTS

Figure 1:
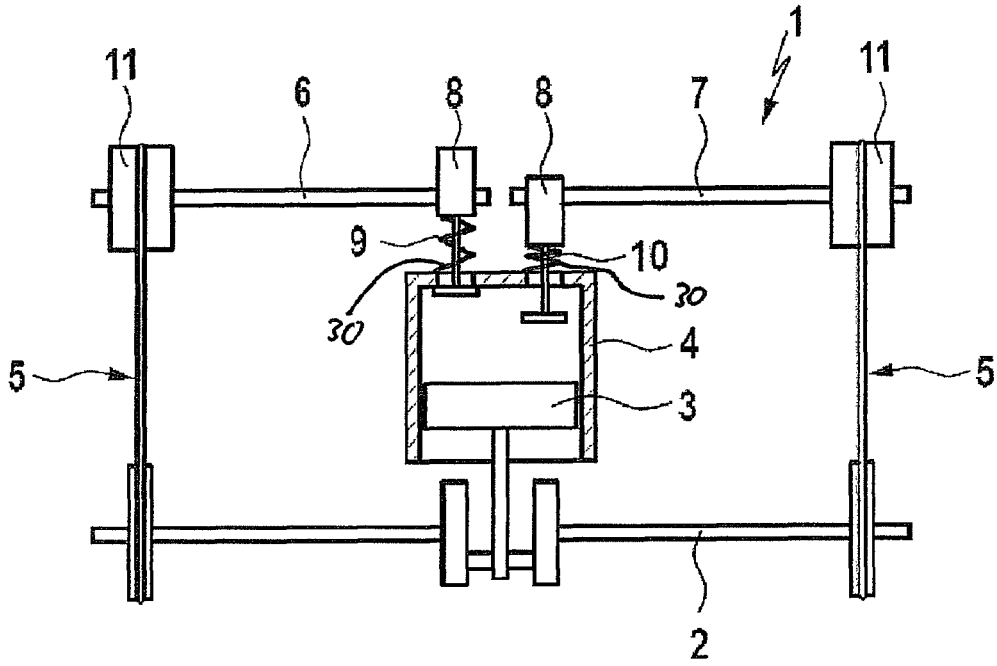
FIG. 1 an internal combustion engine, only schematically.

FIG. 1 schematically shows an internal combustion engine 1, with a piston 3 in a cylinder 4 located on a crankshaft 2 being indicated. In the embodiment shown, the crankshaft 2 is connected via one traction mechanism 5 each to an intake camshaft 6 and/or an exhaust camshaft 7, with a first and a second device 11 ensuring a relative rotation between the crankshaft 2 and the camshafts 6, 7. Cams 8 of the camshafts 6, 7, operate one or more intake gas exchange valves 9 and/or one or more exhaust gas exchange valves 10. Additionally it may be provided that only one of the camshafts 6, 7 is equipped with a device 11, or only one camshaft 6, 7, is provided which includes a device 11.

Figure 3:
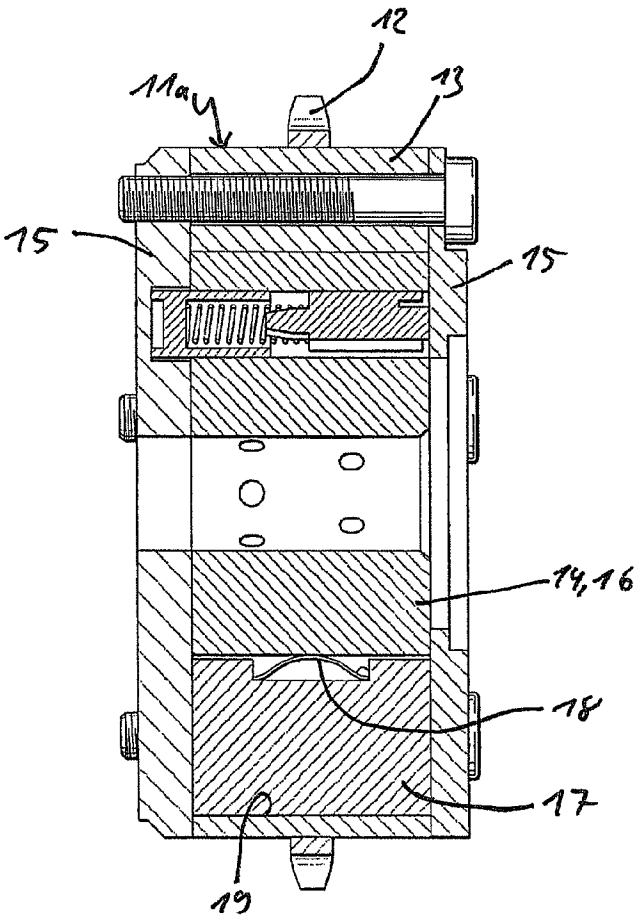
Figure 2:
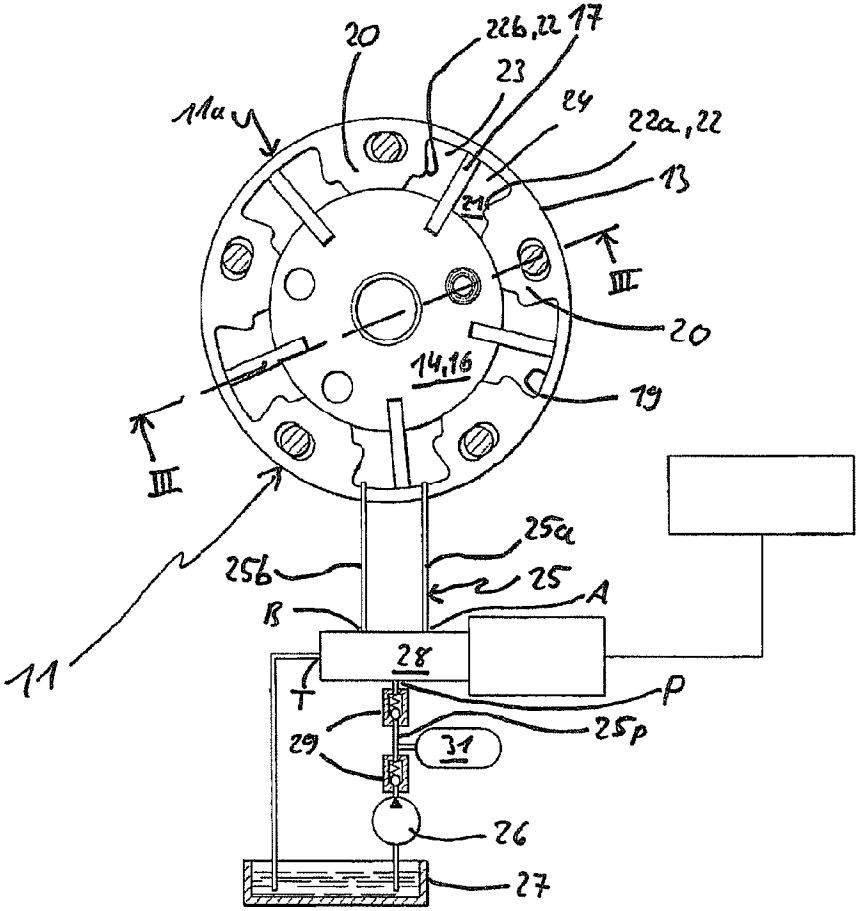
FIG. 2 a device according to the invention, with the phase adjustment device and the hydraulic circuit being shown schematically in a top view, FIG. 3 a longitudinal cross-section through the phase adjustment device of FIG. 2 along the line III-III, FIG. 4 an view showing the alternating torque acting upon the camshaft, FIG. 5 a first embodiment of a volume accumulator, FIG. 6 a second embodiment of a volume accumulator, FIG. 7 a third embodiment of a volume accumulator, and FIG. 8 a fourth embodiment of the volume accumulator.

FIGS. 2 and 3 show a first embodiment of a device 11 according to the invention, with a phase adjustment device 11*a* being shown in a top view and/or in a cross-section and the hydraulic circuit in a schematic fashion. The phase adjustment device 11*a* comprises a drive element 13 and an output element 14. At each of the axial lateral surfaces of the drive element 13 a lateral cover 15 is fastened in a torque-proof fashion. The output element 14 is embodied in the form of an impeller and essentially comprises a cylindrically embodied hub element 16, with in the embodiment shown five blades 17 extending from its exterior cylindrical casing in the radial direction outwardly. The blades 17 are embodied separated from the drive element 14 and arranged in blade grooves of the hub element 16. The blades 16 are impinged radially outwardly with a force via torsion springs 18, which are arranged between the base of the grooves of the blade grooves and the blades 17.

Starting at an exterior circumferential wall 19 of the drive element 13 several projections 20 extend radially inwardly. In the embodiment shown the projections 20 are embodied in one piece with the circumferential wall. The drive element 13 is supported on the drive element 14, rotational in reference thereto, via radially inwardly located circumferential walls of the projections 20.

A sprocket 12 is arranged at an exterior casing surface of the drive element 13, by which a torque can be transferred from the crankshaft 2 via a chain drive, not shown, to the drive element 13.

Within the phase adjustment device 11*a*, a pressure chamber 21 is embodied between each two adjacent projections 20 arranged in the circumferential direction. Each of the pressure chambers 21 is limited in the circumferential direction by opposite, essentially radially extending limiting walls 22 of neighboring projections 20, in the axial direction by lateral covers 15, radially inwardly by the hub element 16, and radially outwardly by the circumferential wall 19. A blade 17 projects into each of the pressure chambers 21, with the blades 17 being embodied such that they contact both the lateral covers 15 as well as the circumferential wall 19. Thus, each blade 17 divides the respective pressure chamber 21 into two pressure chambers 23, 24 acting opposite each other.

The output element 14 is received in the drive element 13 and supported in a rotary fashion thereto over a defined angular range. The angular range is limited in the rotary direction of the drive element 14 such that the blades 17 contact one a corresponding limiting wall 22 each (early stop 22*a*) of the pressure chambers 21. Similarly, the angular range is limited in the other direction such that the blades 17 contact the other limiting walls 22 of the pressure chambers 21, which serve as the late stop 22*b*.

By impinging a group of pressure chambers 23, 24 with pressure and releasing the pressure of the other group the phase position of the drive element 14 can be varied in reference to the drive element 13. By impinging both groups of pressure chambers 23, 24 with pressure the phase position can be held constant. Alternatively it may be provided that the pressure chambers 23, 24 during the phases of constant phase position are impinged with pressure medium. Usually the oil of the internal combustion engine 1 is used as the hydraulic pressure medium.

A hydraulic circuit 25 is provided for the supply with pressure medium and/or the draining of pressure medium from the pressure chambers 23, 24, which comprises a pressure medium pump 26, a pressure medium reservoir 27, a control valve 28, and several pressure medium lines 25*a,b,p*. The control valve 28 comprises an inlet connection P, a tank connection T, and two operating connections A, B. The first pressure medium line 25*a* connects the first operating connection A with the first pressure chambers 23. The second pressure medium line 25*b* connects the second operating connection B with the second pressure chambers 24. The third pressure medium line 25*p* connects the pressure medium pump 26 with the inlet connection P.

Pressure medium transported by the pressure medium pump 26 is supplied via the third pressure medium line 25*p* to the inlet connection P of the control valve 28. Depending on the control status of the control valve 28, the inlet connection P is connected to the first pressure medium line 25*a*, the second pressure medium line 25*b*, or both and/or none of the pressure medium lines 25*a,b*.

In order to shift the control timing (opening and closing time) of the gas exchange valves 9, 10 in the early direction the pressure medium supplied to control valve 28 via the third pressure medium line 25*p* is guided via the first pressure medium line 25*a* to the first pressure chambers 23. Simultaneously, the pressure medium from the second pressure chambers 24 reaches via the second pressure medium line 25*b* the control valve 28 and is ejected into the pressure medium reservoir 27. This way the blades 17 are shifted in the direction of the early stop 22*a*, thus a rotary motion of the output element 14 is achieved in reference to the drive element 13 in the rotary direction of the phase adjustment device 11*a*.

In order to shift the control timing of the gas exchange valve 9, 10 in the late direction, the pressure medium supplied to the control valve 28 via the third pressure medium line 25*p* is guided via the second pressure medium line 25*b* to the second pressure chambers 24. Simultaneously pressure medium from the first pressure chambers 23 reaches via the first pressure medium line 25*a* the control valve 28 and is ejected into the pressure medium reservoir 27. This way the blades 17 are shifted in the direction towards the late stop 22*b*, thus leading to a rotary motion of the output element 14 in reference to the drive element 13 against the rotary direction of the phase adjustment device 11*a*.

In order to hold the control timing constant the supply of pressure medium is either prevented or permitted to all pressure chambers 23, 24. This way, the blades 17 inside the respective pressure chambers 21 are hydraulically clamped and any rotary motion of the output element 14 in reference to the drive element 13 is prevented.

Figure 4:
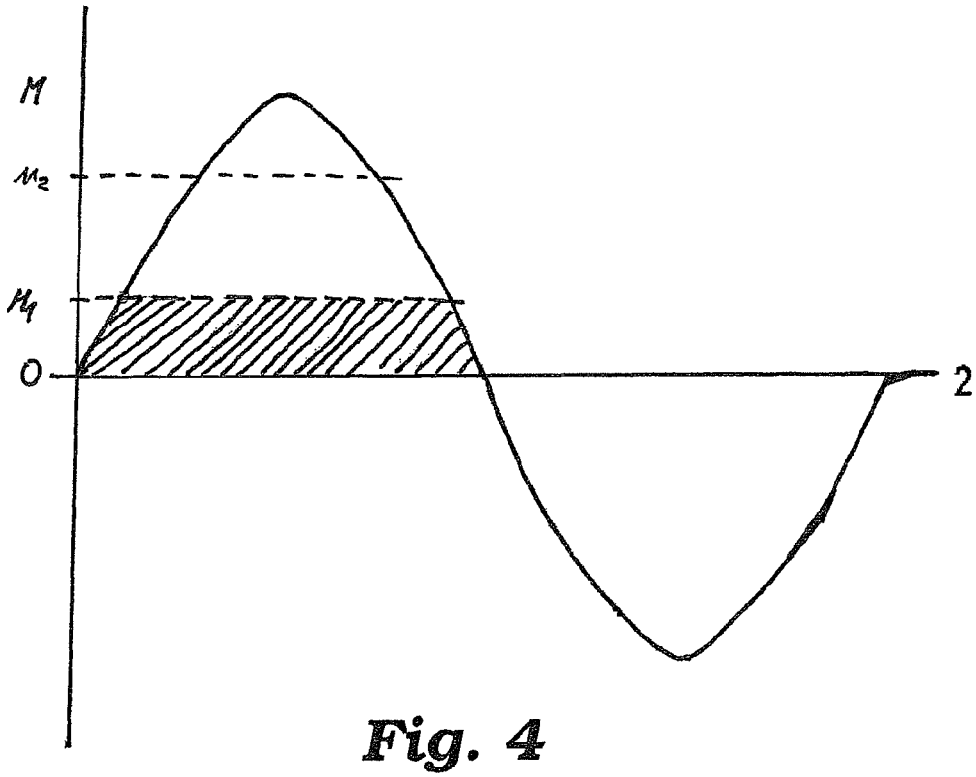

During the operation of the internal combustion engine 1, the camshaft 6, 7 rotates about its longitudinal axis. Here, each gas exchange valve 9, 10 is periodically opened against the force of a valve spring 30 and closed again. During the open phase of the gas exchange valve 9, 10 (approaching cam) a braking torque is applied upon the camshaft 6, 7, which is equivalent to the vector product of the force of the valve spring 30 with the lever of the cam 8. During the closing of the gas exchange valve 9, 10 (removing cam) an accelerating torque acts upon the camshaft 6, 7, which is equivalent to the vector product of the force of the valve spring 30 with the lever of the cam 8. In this way, a periodic, alternating torque M acts upon the camshaft 6, 7, which is shown in FIG. 4 applied over the crankshaft angle $\alpha$.

During a phase shift in the direction of later (earlier) control timing the positive (negative) portion of the alternating torque M, shown in FIG. 4, supports the phase shift. Here, the output element 14 is adjusted both by the system pressure provided by the pressure medium pump 26 as well as by the positive (negative) portion of the alternating torque M towards earlier (later) control timing and thus the speed of the phase adjustment is increased. In internal combustion engines 1 with high alternating torque M this may lead to the adjustment process induced by the alternating torque M occurring with such a high speed that the volume of pressure medium transported by the pressure medium pump 26 is insufficient to properly supply the expanding second (first) pressure chambers 24, (23) with pressure medium. As a consequence, in the second (first) and third pressure medium line 25*b* (*a*), *p* a vacuum develops which counteracts the adjustment process. Thus, the alternating torques M acting upon the camshaft 6, 7 cannot be optimally utilized, and instead they act only up to a limit torque $M_1$.

Simultaneously the negative (positive) portion of the alternating torque M acts against the phase adjustment. When the negative (positive) portion of the alternating torque M exceeds the torque generated by the pressure medium pump 26 the pressure medium is removed from the second (first) pressure chambers 24 (23) into the second (first) and third pressure medium line 25*b* (*a*), *p* and a brief phase adjustment occurs opposite the desired direction.

In order to prevent these effects, the pressure medium pump 26 can be sized appropriately bigger, thus the installation space required, the costs, and the fuel consumption of the internal combustion engine 1 are increased.

Figure 5:
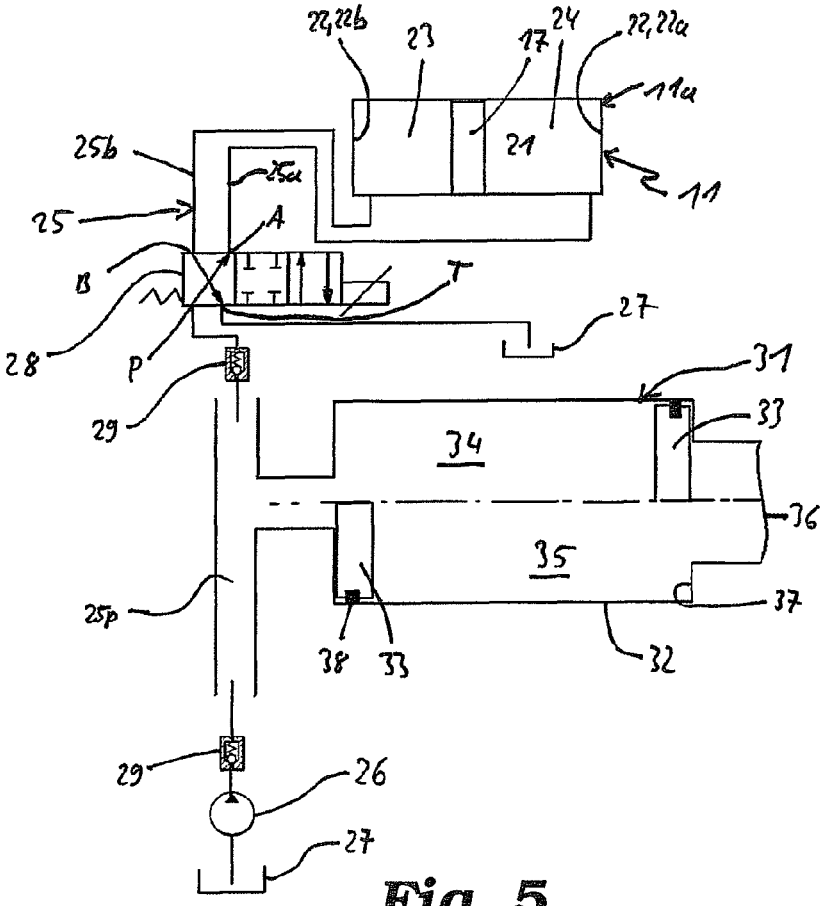

Alternatively, according to the invention a volume accumulator 31 can be provided. FIG. 5 shows a potential embodiment of a volume accumulator 31, which is arranged inside the internal combustion engine 1. It comprises a housing 32, in which a separating element 33 is arranged that is free floating and can be freely shifted. The separating element 33 is embodied as a piston in the embodiment shown, which divides the housing 32 into a supply chamber 34 and a complementary chamber 35. Here, the piston carries a sealing element 38, which seals the two chambers from each other. The supply chamber 34 connects to the third pressure medium line 25*p* between two (optional) check valves 29. The complementary chamber 35 communicates via the ventilation opening 36 with the interior of the internal combustion engine 1.

When the pressure in the third pressure medium line 25*p* exceeds the pressure existing in the interior of the internal combustion engine 1, the piston is shifted by the pressure medium flowing in the housing 32 in the direction of the limit stop 37. This way the volume of the storage chamber 34 increases at the expense of the volume of the complementary chamber 35 until the piston contacts the limit stop 37 (FIG. 5, upper illustration of the volume accumulator 31). Simultaneously the gas present in the complementary chamber 35 can evacuate via the ventilation opening 35 into the interior of the internal combustion engine 1.

Different from pressure springs or gas accumulators known from prior art here no force accumulator is provided, for example a pressure spring or a compressible gas cushion, which during the filling process is stressed. Here the volume accumulator 31 is arranged such that the displacement path of the separating element 33 extends perpendicular in reference to gravity. This way, gravity is not effective in the direction of displacement of the separating element 33, thus the volume storage 31 is not emptied during down-times of the internal combustion engine, either.

The volume accumulator 31 reaches its completely filled state already at low system pressures. Furthermore, no automatic emptying of the volume accumulator 31 occurs during falling system pressure in the third pressure medium line 25*p*, as long as the pressure is greater or equal to the pressure existing inside the internal combustion engine 1.

When an alternating torque M acts upon the camshaft 6, 7 supporting the phase adjustment the pressure medium is suctioned from the first and/or second pressure medium line and the third pressure medium line 25*a,b,p* into the expanding pressure chambers 23, 24, thus lowering the pressure in these pressure medium lines 25*a, b, p* below the pressure existing inside the internal combustion chamber 1. Consequently the volume of pressure medium stored in the supply chamber 34 is suctioned into the third pressure medium line 25*p* and further transported to the respective pressure chambers 23, 24. Here, the piston is shifted inside the housing 32 in the direction of the outlet opening of the supply chamber 34 (FIG. 5, lower illustration of the volume accumulator 31). Thus the phase adjustment device 11*a* provides an additional pressure medium volume, which is only mobilized when the volume of pressure medium transported by the pressure medium pump 26 is lower than the volume of pressure medium required for the phase adjustment induced by the alternating torque M. This way, the maximally utilized limit torque $M_2$ and thus the phase adjustment speed is significantly increased.

When the alternating torque M acting upon the camshaft 6, 7 against the phase adjustment direction the check valves 29 prevent pressure medium from the pressure chambers 23, 24 from being pushed into the volume accumulator 31 and/or in the hydraulic circuit 25; the pressure medium is supported by the check valve 29.

This way the supporting portion of the alternating torque M is used to a higher degree for increasing the speed of phase adjustment and the opposite acting portion is compensated. Here, the emptying of the volume accumulator 31, due to the freely displaceable piston (i.e. the lack of a force accumulator), only begins when the volume of pressure medium transported by the pressure medium pump 26 is smaller than the volume of pressure medium required.

In this embodiment the piston is embodied as a cylindrical part and may comprise a metallic material or a suitable plastic. The limit stop 37 surrounds the ventilation opening 36, with its surface facing the piston being embodied smaller than the piston area in order to reduce adhesion forces.

Figure 6:
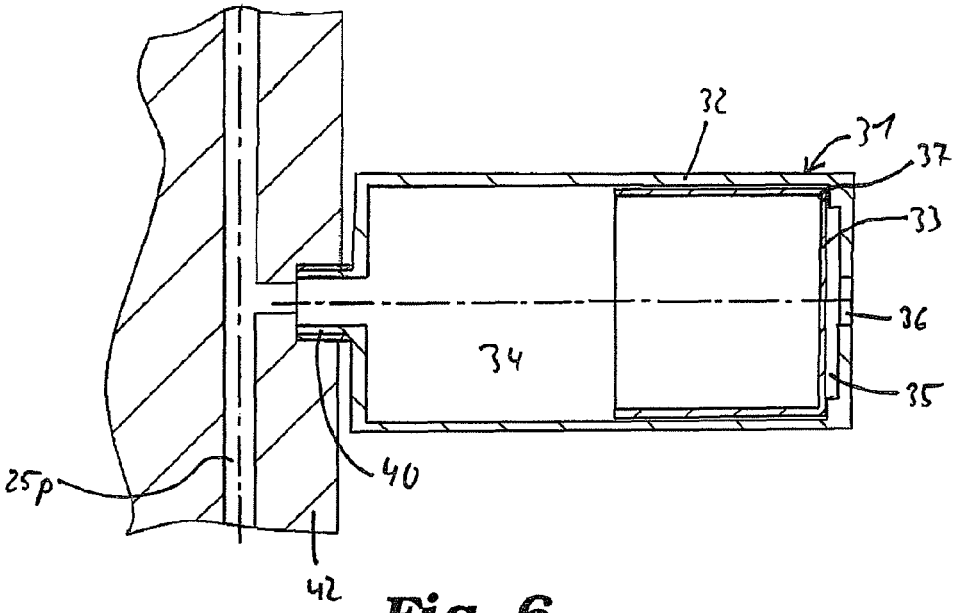

FIG. 6 shows a second embodiment of a volume accumulator 31 of a device 11 according to the invention. Contrary to the first embodiment the piston is embodied cup-shaped and made from sheet metal in a deep-drawing process. The sealing of the supply chamber 34 from the complementary chamber 35 occurs via a narrowly tolerated sealing gap between the exterior jacket surface of the piston and the interior jacket surface of the housing 32. The limit stop 37 is embodied in one piece with the housing 32. Also possible are embodiments in which the limit stop 37 is made as a separate part and fastened in the housing 32. Here, the separate limit stop 37 may be embodied as an O-ring, thus increasing the sealing effect between the piston and the housing 32 when the volume accumulator 31 is completely filled.

The housing 32 comprises a pin 40 with a penetrating bore, which opens on the one side in the supply chamber 34 and on the other side in the third pressure medium line 25*p*. Using a thread formed at the exterior casing surface of the pin 40, the housing 32 is fastened to an environmental construction 42, for example a cylinder head or a crank housing.

Figure 7:
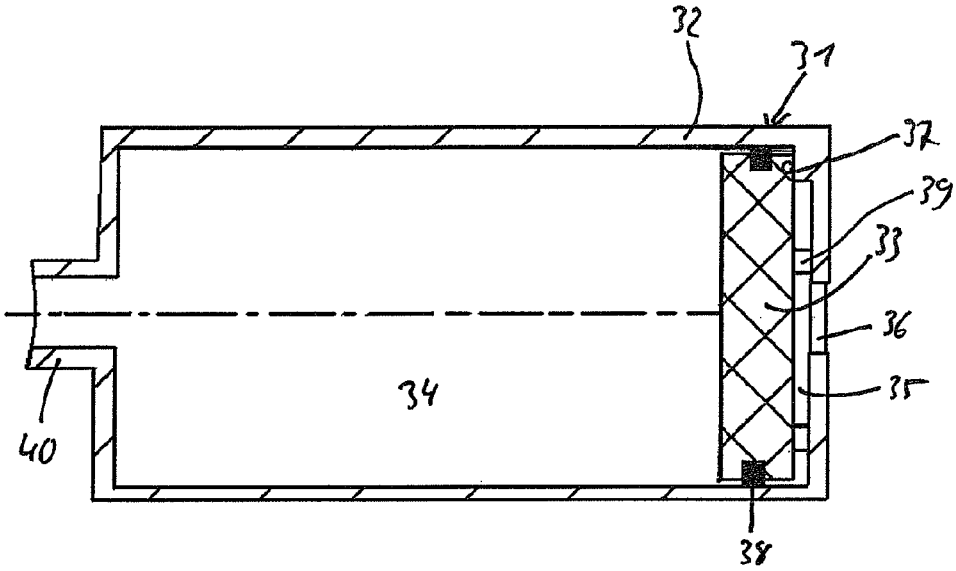

FIG. 7 shows a third embodiment of a volume accumulator 31 of a device 11 according to the invention. Contrary to the first embodiment the limit stop 37 is interrupted in the circumferential direction by recesses 39, thus reducing the contact area between the piston and the limit stop 37 and also the adhesion forces acting between these parts. In this embodiment the piston is made from a suitable plastic and may be provided with reinforcement ribs.

Figure 8:
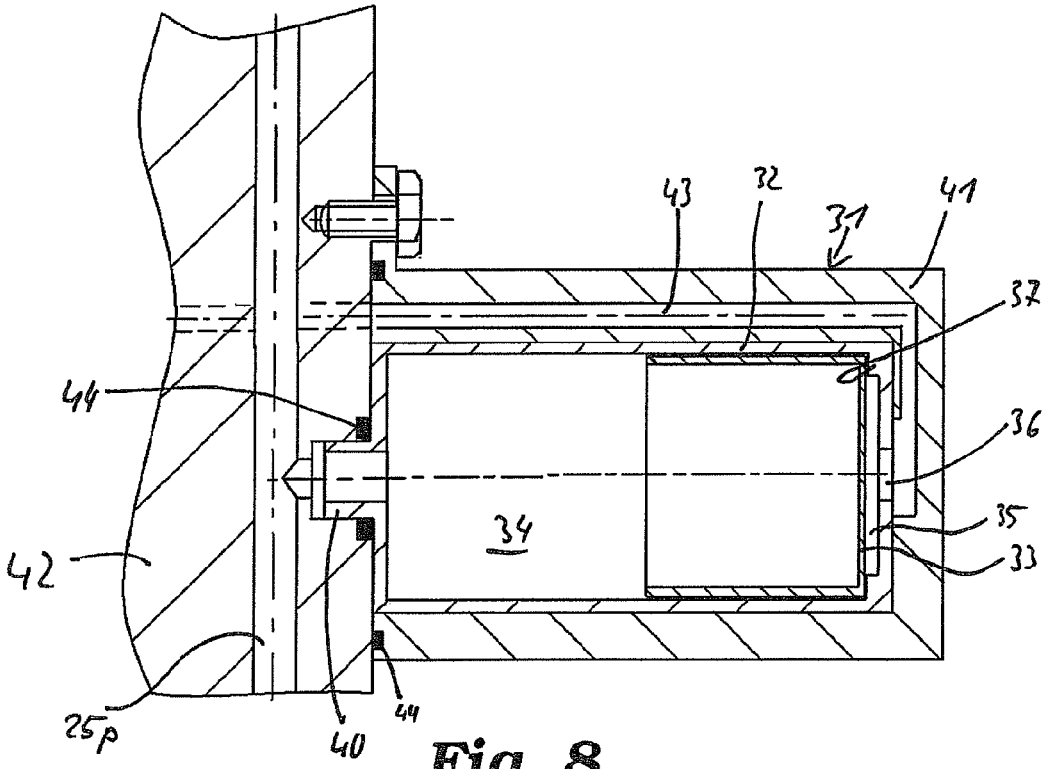

FIG. 8 shows a fourth embodiment of the volume accumulator 31 of a device 11 according to the invention. Contrary to the previous embodiments this volume accumulator 31 is arranged outside the internal combustion engine 1. The housing 32 comprises a pin 40 with a penetrating bore, which in turn opens on one side in the supply chamber 34 and on the other side in the third pressure medium line 25*p*. The housing 32 is capped by a second housing 41, which is fastened by a screw connection to the cylinder head 42. Within the second housing 41 a ventilation line 43 is formed, by which the complementary chamber 35 communicates with the interior of the internal combustion engine 1. Thus, gas and pressure medium can be guided from the complementary chamber 35 into the interior of the internal combustion engine 1 when the piston is moved in the direction towards the limit stop 37. At the contact area between the cylinder head 42 and the first and/or second housing 31, 41, sealing rings 44 are provided in order to prevent the emission of pressure medium. Embodiments are also possible in which only a thick-walled housing 31 is provided in which the ventilation line 43 is embodied.

LIST OF REFERENCE CHARACTERS

1 Internal combustion engine
2 Crankshaft
3 Piston
4 Cylinder
5 Traction mechanism
6 Inlet camshaft
7 Outlet camshaft
8 Cam
9 Inlet gas exchange valve
10 Outlet gas exchange valve
11 Device
11*a* Phase adjustment device
12 Sprocket
13 Drive element
14 Output element
15 Lateral cover
16 Hub element
17 Blade
18 Torsion spring
19 Circumferential wall
20 Projection
21 Pressure chamber
22 Limiting wall
22*a* Early stop
22*b* Late stop
23 First pressure chamber
24 Second pressure chamber
25 Hydraulic circuit
25*a* First pressure medium line
25*b* Second pressure medium line
25*p* Third pressure medium line
26 Pressure medium pump
27 Pressure medium pump
28 Control valve

29 Check valve
30 Valve spring
31 Volume accumulator
32 Housing
33 Separating element
34 Supply chamber
35 Complementary chamber
36 Ventilation opening
37 Limit stop
38 Sealing element
29 Recess
40 Pin
41 Second housing
42 Environmental structure
43 Ventilation line
44 Gasket
A First operating connection
B Second operating connection
P Inlet connection
T Outlet connection
$\alpha$ Crankshaft angle
M Alternating torque
$M_1$, $M_2$ Limit torque

The invention claimed is:

1. A device for the variable adjustment of the control timing of gas exchange valves of an internal combustion engine, comprising:

a drive element, an output element, at least one pressure chamber, and a volume accumulator, the output element being arranged rotatably in reference to the drive element, and the pressure chamber being limited at least partially by the drive element and the output element, a phase position being variably adjustable between the output element and the drive element by at least one of a supply of pressure medium to or a drainage of pressure medium from the pressure chamber, pressure medium lines being provided, via which pressure medium can be supplied to the pressure chamber or drained therefrom, the volume accumulator comprising at least one housing and a separating element that is free floating and displaceable therein, which separates a supply chamber which communicates with one of the pressure medium lines, from a ventilated complementary chamber, the separating element being displaced in the housing by impingement of the pressure medium in the supply chamber such that a volume of the supply chamber increases at the expense of the complementary chamber.

2. A device according to claim 1, wherein the separating element is exclusively displaced by a pressure existing in the pressure medium line communicating with the volume accumulator.

3. A device according to claim 1, wherein the complementary chamber comprises a ventilation opening communicating with an interior of the internal combustion engine.

4. A device according to claim 1, further comprising a control valve and at least a second pressure chamber, which acts against the first pressure chamber and a first one of the pressure medium lines communicates with the control valve and the first pressure chamber, that a second one of the pressure medium lines communicates with the control valve and the second pressure chamber, and a third one of the pressure medium lines communicates with the control valve and a pressure medium pump, with the supply chamber communicating with the third pressure medium line.

5. A device according to claim 1, wherein a check valve is arranged upstream in the pressure medium line communicating with the supply chamber and a check valve is arranged downstream in reference to the volume accumulator, with both of the check valves preventing a return flow of pressure medium in a direction of at least one of the volume accumulator or the pressure medium pump.

6. A device according to claim 1, wherein the separating element is a piston.

7. A device according to claim 6, wherein the piston is cup-shaped and formed from a sheet-metal blank.

8. A device according to claim 6, wherein a limit stop for the piston is provided in the complementary chamber.

9. A device according to claim 8, wherein a contact area of the limit stop is smaller than an area of the piston limiting the complementary chamber.

10. A device according to claim 8, wherein the limit stop surrounds a ventilation opening of the complementary chamber.

11. A device according to claim 1, wherein the volume accumulator is arranged inside the internal combustion engine.

12. A device according to claim 1, wherein the volume accumulator is arranged outside the internal combustion engine, with a vent line being provided, which on one side communicates with the complementary chamber and on the other side communicates with the interior of an internal combustion engine.

* * * * *